US006986299B2

(12) United States Patent
White et al.

(10) Patent No.: US 6,986,299 B2
(45) Date of Patent: Jan. 17, 2006

(54) CONTROLLED CUTTING OF MULTIPLE WEBS TO PRODUCE ROOFING SHINGLES

(75) Inventors: James Franklin White, Sylvania, OH (US); David Russell Rodenbaugh, Baltimore, OH (US)

(73) Assignee: Owens Corning Fiberglas Technology, Inc., Summit, IL (US)

( * ) Notice: Subject to any disclaimer, the term of this patent is extended or adjusted under 35 U.S.C. 154(b) by 187 days.

(21) Appl. No.: 10/029,514

(22) Filed: Dec. 20, 2001

(65) Prior Publication Data

US 2002/0088324 A1 Jul. 11, 2002

Related U.S. Application Data

(62) Division of application No. 09/427,425, filed on Oct. 26, 1999, now Pat. No. 6,360,638.

(51) Int. Cl.
*B26D 3/00* (2006.01)

(52) U.S. Cl. ..... 83/76.1; 83/311; 83/312; 83/364

(58) Field of Classification Search ..... 83/13, 83/32, 74, 76, 311, 312, 364, 365, 367, 76.1; 52/554

See application file for complete search history.

(56) References Cited

U.S. PATENT DOCUMENTS

| | | | | |
|---|---|---|---|---|
| 4,267,752 A | | 5/1981 | Byrt et al. | |
| 4,499,702 A | | 2/1985 | Turner | |
| 5,052,162 A | | 10/1991 | Bush et al. | |
| 5,102,487 A | | 4/1992 | Lamb | |
| 5,186,980 A | | 2/1993 | Koschitzky | |
| 5,209,802 A | * | 5/1993 | Hannah et al. | 156/250 |
| 5,283,080 A | | 2/1994 | Lamb et al. | |
| 5,695,846 A | * | 12/1997 | Lange et al. | 428/98 |
| 5,768,959 A | | 6/1998 | Lorenzo | |
| 6,010,589 A | | 1/2000 | Stahl et al. | |
| 6,360,638 B1 | * | 3/2002 | White et al. | 83/13 |
| 6,521,076 B1 | * | 2/2003 | Elliott | 156/259 |

* cited by examiner

*Primary Examiner*—M. Rachuba
(74) *Attorney, Agent, or Firm*—Inger H. Eckert; James J. Dottavio

(57) ABSTRACT

In a method of cutting roofing shingles, multiple webs of roofing material are moved to a cutter. The webs are positioned in stacked relationship prior to the cutter. The webs have distinct portions such as tabs. The locations of the distinct portions of the moving webs are sensed by sensors. End cuts are simultaneously cut through the multiple stacked webs with the cutter to produce separate roofing shingles from the webs. The movements of the webs are controlled, based on the sensed locations of the distinct portions, so that the end cuts of the roofing shingles are positioned at predetermined locations relative to the distinct portions.

7 Claims, 3 Drawing Sheets

CONTROLLED CUTTING OF MULTIPLE WEBS TO PRODUCE ROOFING SHINGLES

CROSS REFERENCE TO RELATED APPLICATION(S)

This application is a divisional of U.S. Ser. No. 09/427,425, filed Oct. 26, 1999, now U.S. Pat. No. 6,360,638 hereby incorporated by reference.

TECHNICAL FIELD AND INDUSTRIAL APPLICABILITY OF THE INVENTION

This invention relates to a method and apparatus for cutting roofing shingles. More particularly, the invention relates to a method of controlled cutting of multiple stacked webs of roofing material to produce roofing shingles having end cuts positioned at predetermined locations relative to distinct portions of the shingles.

BACKGROUND OF THE INVENTION

In a common method of manufacturing laminated roofing shingles, a continuous mat such as a glass fiber mat is coated with asphalt and surfaced with granules, then cut longitudinally into overlay and underlay strips. The overlay strip is cut with a sawtooth pattern of tabs and cutouts. The underlay strip is positioned beneath the overlay strip, and the strips are joined together with adhesive to produce a continuous web of roofing material. The continuous web is cut laterally with an end cutter to produce separate laminated roofing shingles. In the manufacture of non-laminated roofing shingles, the shingles are cut with a plurality of tabs divided by slots.

The tabs, cutouts and slots are distinct portions of the roofing shingles that are distinguishable from adjacent portions of the shingles. The roofing shingles may also have other distinct portions, such as areas of the granules that are different in color or shading from adjacent areas.

When cutting roofing shingles, it is usually desirable to position the end cuts of the shingles at predetermined locations relative to the distinct portions. Such positioning is desirable for various reasons, including manufacturing predictability and improved aesthetic quality of the shingles. When the distinct portions are tabs, such positioning also avoids the formation of narrow end tabs that may tear away from the roofing shingles during manufacture or installation. U.S. Pat. No. 5,102,487 to Lamb discloses a method and apparatus for manufacturing laminated roofing shingles in which the end cutter is maintained in phase with the pattern of tabs on the web to control the positioning of the end cuts relative to the tabs.

To increase the productivity of the manufacturing operation, it would be advantageous to be able to simultaneously cut multiple stacked webs of roofing material with a single end cutter to produce multiple shingles at a time. However, the simultaneous cutting of multiple stacked webs of roofing material would greatly increase the difficulty in positioning the end cuts at predetermined locations relative to the distinct portions of the multiple webs. The Lamb patent does not disclose or suggest the simultaneous cutting of multiple stacked webs of roofing material. End cutters for cutting two stacked webs of roofing material are known, but the end cutters have not been used in a controlled method in which the end cuts are positioned at predetermined locations relative to the distinct portions of the webs. Therefore, it would be desirable to provide a method of controlled cutting of multiple stacked webs of roofing material to produce roofing shingles having end cuts positioned at predetermined locations relative to the distinct portions.

SUMMARY OF THE INVENTION

The above object as well as others not specifically enumerated are achieved by a method of cutting roofing shingles according to the invention. In the method, multiple webs of roofing material are moved to a cutter. The webs are positioned in stacked relationship prior to the cutter. The webs have distinct portions such as tabs. The locations of the distinct portions of the moving webs are sensed by sensors. End cuts are simultaneously cut through the multiple stacked webs with the cutter to produce separate roofing shingles from the webs. The location of the cutting is controlled, based on the sensed locations of the distinct portions, so that the end cuts of the roofing shingles are positioned at predetermined locations relative to the distinct portions.

Apparatus for cutting roofing shingles according to the invention includes a multiple-cut shingle cutter adapted to simultaneously cut end cuts through multiple stacked webs of roofing material to produce separate roofing shingles from the webs. The apparatus also includes feeders adapted to move the webs to the cutter, and web handling apparatus adapted to position the webs in stacked relationship prior to the cutter. Sensors are provided to sense the locations of the distinct portions of the moving webs. The apparatus further includes a controller adapted to control the location of the cutting based on the sensed locations of the distinct portions, so that the end cuts of the roofing shingles are positioned at predetermined locations relative to the distinct portions.

Various objects and advantages of this invention will become apparent to those skilled in the art from the following detailed description of the preferred embodiment, when read in light of the accompanying drawings.

DETAILED DESCRIPTION AND PREFERRED EMBODIMENTS OF THE INVENTION

Figure 1:
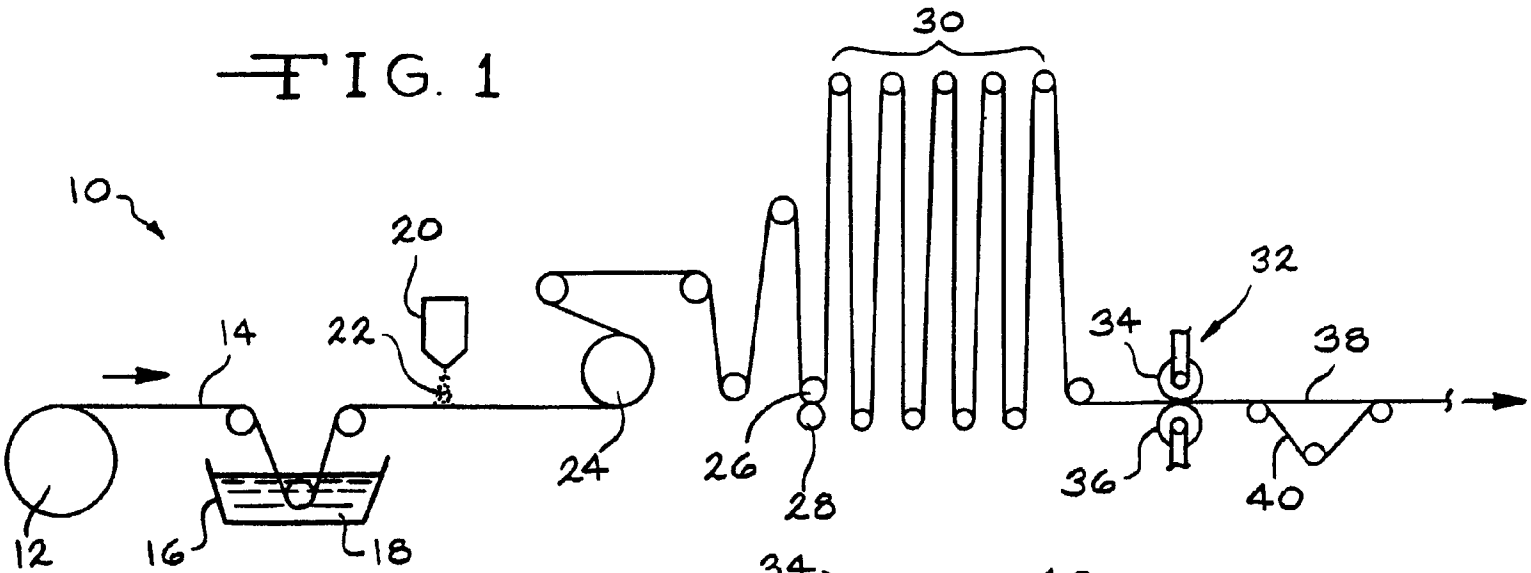
FIG. 1 is a schematic view in elevation of apparatus for manufacturing first and second laminated webs of roofing material for use in the invention.

Referring now to the drawings, there is shown in FIG. 1 an apparatus 10 for manufacturing first and second laminated webs of roofing material for use in the invention. It should be understood that, although the invention will be illustrated with reference to laminated webs, the invention is not limited to laminated webs. The term "web" means any piece of roofing material that can be cut into roofing shingles, including laminated and single-layered pieces of roofing material. Thus, the invention relates to both laminated roofing shingles and non-laminated or "three-tab" roofing shingles.

Further, although the invention will be illustrated with reference to first and second webs of roofing material, the invention is not limited to the cutting of two webs. Rather, the invention relates to the controlled cutting of multiple webs of roofing material, i.e., any number of webs greater than one. In some embodiments, the invention relates to the controlled cutting of more than two webs of roofing material. Thus, although the invention is illustrated with reference to a 2-wide process for producing two webs, the invention is also applicable to a 4-wide process for producing four webs, or any other process which produces multiple webs of roofing material.

As shown in FIG. 1, a mat or substrate is payed out from a roll 12 as a continuous sheet 14. The mat can be any type of material known for use in reinforcing roofing shingles, such as a web, scrim or felt of fibrous materials such as mineral fibers, cellulose fibers, rag fibers, mixtures of mineral and synthetic fibers, or the like. Preferably, the mat is a nonwoven web of glass fibers.

The sheet is passed through a coater 16 where a coating 18 is applied to the sheet. The coating can be applied in any suitable manner. In the illustrated embodiment, the sheet is submerged in a supply of hot, molten coating to completely cover the sheet with the tacky coating. However, in other embodiments, the coating can be sprayed on, rolled on, or applied to the sheet by other means.

The term "coating" means any type of material suitable for coating roofing shingles. Usually, the coating includes a bituminous material such as an asphalt, tar, pitch, or a mixture thereof. The asphalt can be either a manufactured asphalt produced by refining petroleum or a naturally occurring asphalt. The coating can also include various additives and/or modifiers, such as inorganic fillers or mineral stabilizers, organic materials such as polymers, recycled streams, or ground tire rubber.

The hot coated sheet is passed beneath one or more granule applicators 20 that discharge protective surface granules 22 onto the top of the sheet. In the manufacture of colored shingles, two types of granules are typically employed. Headlap granules are granules of relatively low cost used for the portion of the shingle that will be covered up on the roof. Colored granules or prime granules are of relatively higher cost and are applied to the portion of the shingle that will be exposed on the roof. The granules may be applied such that some areas of the granules are different in color or shading from adjacent areas. For example, the exposed portion of the shingle may include background granules and a series of "blend drops", which are granule deposits having a different color or a different shade from the background granules.

The sheet is passed around a drum 24 that presses the granules into the hot, tacky coating and inverts the sheet sufficiently for any non-adhering granules to fall into a hopper (not shown) for recycling. The sheet is then passed between a pair of press rolls 26, 28 that further press the granules into the sheet. Next, the sheet is passed through a conventional cooling section 30 in which it is passed up and down between a number of rolls and sprayed with water to cool the hot coating.

Figure 2:
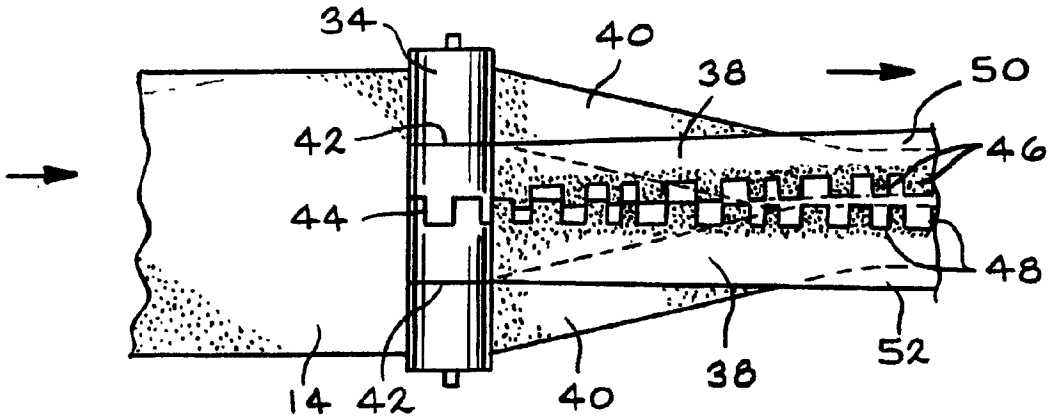
FIG. 2 is a plan view of a portion of the apparatus of FIG. 1, including a pattern cutter and the lamination process.

As shown in FIGS. 1 and 2, after the cooling process, the sheet is fed through a pattern cutter 32 consisting of a knife roll 34 and an anvil roll 36. The knife roll 34 engages the continuous sheet 14 and divides it into continuous overlay strips 38 and underlay strips 40. The knife roll has two straight blades 42 that divide the underlay strips from the overlay strips, and a patterned blade 44 that cuts the overlay strip into two continuous overlay strips having a sawtooth pattern of tabs 46 and cutouts 48. The patterned blade can be changed to produce different pattern lengths. For example, the patterned blade may form one pattern for every revolution of the knife roll. In such a case, the length of the pattern can be varied by changing the circumference of the knife roll. The patterned blade can also be changed so that it forms more or less than one pattern for every revolution of the knife roll.

The overlay and underlay strips are separated from each other, then the underlay strips are positioned beneath the overlay strips, and the overlay and underlay strips are joined together by any suitable laminating apparatus (not shown) to produce first and second laminated webs 50, 52. Suitable laminating apparatus is well known in the art, and could include, for example, guiding conveyor belts, an adhesive applicator, and apparatus for pressing the overlay and underlay strips together.

After the lamination process, the second web 52 is positioned below the first web 50 by any suitable web handling apparatus (not shown). In a preferred embodiment, one of the webs is inverted (not shown) so that the shingles produced from the webs can be packaged face to face/back to back in a bundle of shingles. However, the web could also be left non-inverted to produce shingles that are packaged face to back in a bundle. Suitable apparatus for positioning and orienting moving webs is well-known in the art. Such apparatus could include, for example, guiding conveyor belts that move the webs into position and invert one of the webs.

Figure 3:
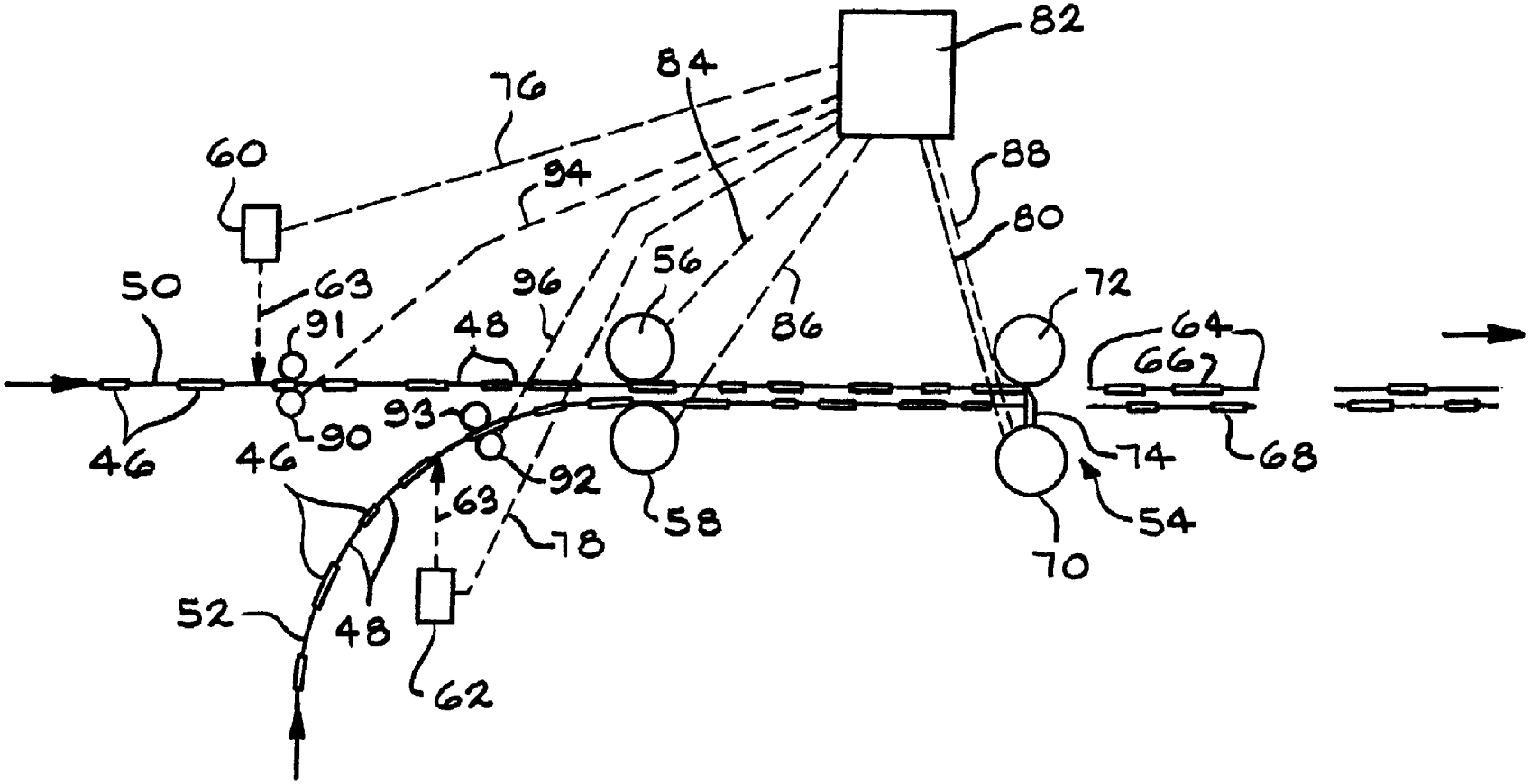
FIG. 3 is a schematic view in elevation of apparatus for cutting roofing shingles according to the invention.

As shown in FIG. 3, the first and second webs 50, 52 are moved along first and second paths, respectively, to an end cutter 54. Preferably, the movements of the first and second webs are independent from each other along at least a portion of the first and second paths. "At least a portion" means that any part, or all, of the movements of the webs along the first and second paths are independent from each other. In the illustrated embodiment, the apparatus includes first and second independently driven feed rolls 56, 58 to move the first and second webs, respectively. The feed rolls can be driven by any suitable drive means, such as electrical or mechanical drive means. The feed rolls are equipped with drive interfaces to allow communication with a controller, as discussed below.

The first and second webs 50, 52 are positioned in stacked relationship prior to the end cutter 54. "Stacked" means that the webs are arranged in layers, usually by positioning one of the webs on top of the other. The webs can be stacked in any suitable manner, and by use of any suitable web handling apparatus. In the illustrated embodiment, the second web 52 was positioned below the first web 50 after the lamination process, and the first and second webs converge at the feed rolls 56, 58 so that the webs are stacked with the first web on top of the second web.

The webs have "distinct portions", which can be any portions of the webs that are distinguishable or recognizable from adjacent portions. In the illustrated embodiment, the distinct portions of the first and second webs 50, 52 are the tabs 46 that are distinguishable from the adjacent cutouts 48. The distinct portions can also be the cutouts. When the webs are non-laminated (not shown), the distinct portions can be the tabs or the slots between the tabs. The distinct portions can also be areas of the granules that are different in color or shading from adjacent areas.

The locations of the distinct portions of the first and second webs are sensed as the webs are moved to the end cutter. Usually, the locations of the distinct portions are difficult to sense, because the distinct portions are not greatly different from the adjacent portions. For example, the tabs on the webs are usually not more than about 0.15 inch (0.38 cm) thicker than the adjacent cutouts, and typically only about 0.1 inch (0.25 cm) thicker. The distinct portions are particularly difficult to sense at the high speeds traveled by the webs during the manufacturing operation. The webs usually move at a speed of at least about 200 feet/minute (61 meters/minute), and typically at a speed within the range of from about 400 feet/minute (122 meters/minute) to about 800 feet/minute (244 meters/minute). The task of sensing the distinct portions of two webs moving along separate paths is significantly more difficult than sensing the distinct portions of a single web.

The locations of the distinct portions of the webs can be sensed by any means suitable for sensing the distinct portions. In the illustrated embodiment, a first location sensor 60 is provided for sensing the locations of the tabs 46 of the first web 50, and a second location sensor 62 is provided for sensing the locations of the tabs 46 of the second web 52. The first and second location sensors are preferably optical sensors that direct laser beams 63 against the webs to detect height differences between the tabs 46 and the cutouts 48. In this manner, the location sensors can detect the leading and trailing edges of the tabs. One type of suitable optical sensor is sold by IDEC Corporation, Sunnyvale, Calif. The first and second location sensors 60, 62 generate location signals 76, 78 representative of the sensed locations of the tabs 46 of the first and second webs, respectively.

Persons skilled in the art appreciate that the sensing of the discrete portions can be performed using a variety of technologies. Additional examples include contacting or non-contacting sensors, such as a magnetic proximity sensor for detecting the proximity of a tab or web to the sensor, to be able to detect the leading edge and trailing edge of each tab. Likewise, optical sensors may be used to detect the line established by the leading edge or trailing edge of a tab. Similarly, optical sensors may be used to detect color changes caused by blend drops or shadings on the shingles.

Preferably, the apparatus also includes distance measuring devices to measure the lengths of the distinct portions. In the illustrated embodiment, a first distance measuring device 90 is provided to measure the lengths of the tabs 46 of the first web 50, and a second distance measuring device 92 is provided to measure the lengths of the tabs 46 of the second web 52. The first and second distance measuring devices 90, 92 generate distance signals 94, 96 representative of the distances. Preferably, the first and second distance measuring devices 90, 92 are pulse generating tachometers having wheels of known diameter that ride on the bottom of the first and second webs, respectively. First and second hold down wheels 91, 93 are positioned on the top of the first and second webs, respectively, opposite the tachometer wheels, to prevent slippage between the tachometer wheels and the webs. The tachometer wheels and the hold down wheels can be formed from any suitable materials, but typically the tachometer wheels are formed from a metallic material such as chrome and the hold down wheels are formed from an elastomeric material such as rubber. The number of pulses per revolution of the tachometer wheel, combined with the circumference of the wheel and the indication from the location sensor, allows the tab length to be determined, for a purpose described below. The distances between the first and second distance measuring devices 90, 92 and the end cutter 54 are known.

The apparatus could also include speed sensors (not shown) to determine the speeds of the moving webs. Usually, the speeds of the moving webs are known from the known speeds of the first and second feed rolls 56, 58.

The first and second webs 50, 52 are moved to the end cutter 54. The end cutter 54 simultaneously cuts end cuts 64 through the first and second stacked webs to produce separate roofing shingles 66, 68 from the webs. The end cutter 54 can be any type of cutting device suitable for simultaneously cutting multiple stacked webs. In a preferred embodiment, the end cutter consists of a knife roll 70 and an anvil roll 72. The knife roll 70 is a rotating cutting cylinder, having a blade 74 that engages the first and second webs and divides them into discrete laminated roofing shingles. One type of suitable end cutter for simultaneously cutting multiple stacked webs is sold by the RDI Company, Itasca, Ill. The end cutter 54 generates signals 80 representative of the timing of the end cuts through the webs. The end cutter can be provided with any suitable interface to allow communication with a controller, as discussed below.

The location of the cutting is controlled, based on the sensed locations of the distinct portions, so that the end cuts of the roofing shingles are positioned at predetermined locations relative to the distinct portions. The location of the cutting can be controlled by controlling the movements of the webs and/or by controlling the timing of the cutting. In the illustrated embodiment, a controller 82 receives the location signals 76, 78 from the location sensors 60, 62, the distance signals 94, 96 from the distance measuring devices 90, 92, and the cutting signals 80 from the end cutter 54. The controller compares the signals with a program containing the predetermined desired locations of the end cuts relative to the tabs. In the illustrated embodiment, the controller receives the signals from the tachometers and the signals from the optical sensors and determines the length of the tabs. Once the tab length is known, through a lookup table the controller determines the current location in the pattern of tabs. The controller sends signals 84, 86 to the first and second feed rolls 56, 58 to speed up or slow down the movements of the first and second webs, so that the end cuts are positioned at the predetermined locations relative to the pattern of tabs. Optionally, the controller could also send signals 88 to the end cutter 54 to speed up or slow down the cutting. Any type of controller suitable for performing these functions can be used in the invention. A preferred type of controller is a microcomputer equipped with specialized software to perform these functions.

In a preferred embodiment, the distinct portions of the first and second webs form repeated patterns, and the location of the cutting is controlled so that the lengths of the roofing shingles are predetermined multiples of the lengths of the patterns. When the end cutter is a rotating cutting cylinder, such as the knife roll 70 shown in FIG. 3, this usually involves controlling the movements of the webs so that the patterns are maintained in phase with the rotation of the cutting cylinder. The controller recognizes the sensed patterns and compares them with a program containing the predetermined desired locations of the end cuts relative to the patterns. The controller sends signals to the first and second feed rolls to speed up or slow down the movements of the first and second webs, so that the patterns of the two webs are aligned with each other, and so that the end cuts are positioned at the predetermined locations relative to the patterns.

Figure 4:
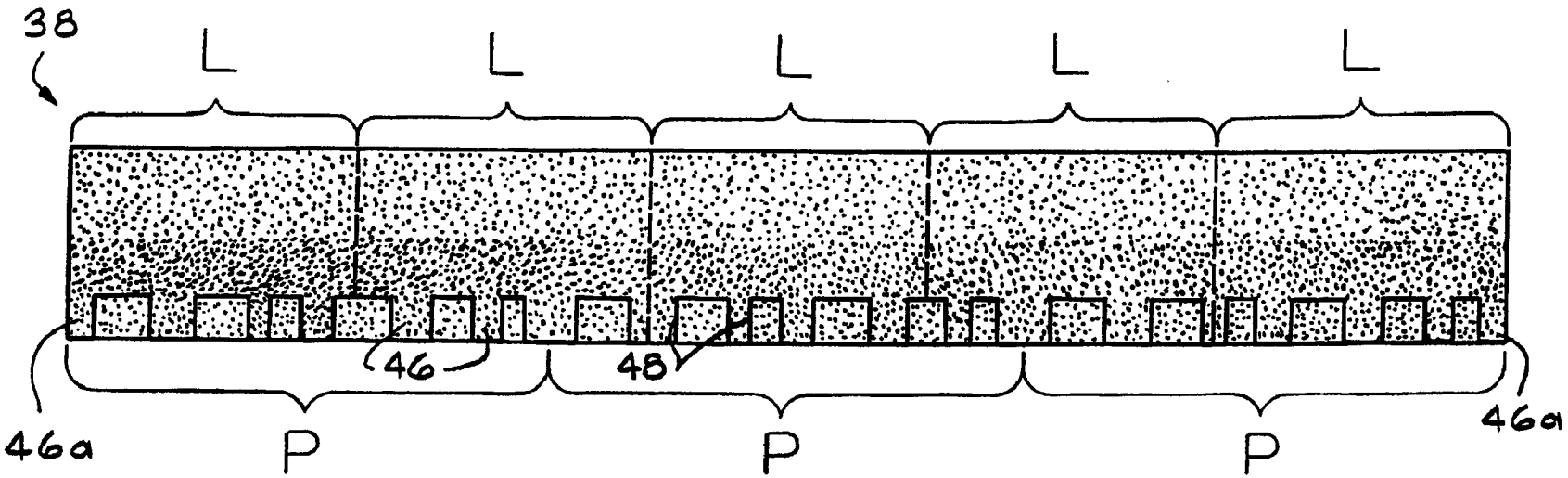
FIG. 4 is a plan view of a web of roofing material, showing how it would be cut into five shingles according to one embodiment of the invention.

FIG. 4 shows an example in which the tabs 46 of the web 50 form a repeated pattern "P", and the web is divided into shingles having length "L". In the illustrated example, five shingle lengths "L" equal three pattern lengths "P", so that the length of the roofing shingle is ⅗ of the length of the pattern. Other examples include, but are not limited to, one shingle length equals one pattern length, or five shingle lengths equal four pattern lengths.

One advantage of controlling the movements of the webs so that the lengths of the shingles are predetermined multiples of the lengths of the patterns, is that the manufacturer is assured of the exact design of each shingle produced. This enables the manufacturer to avoid making shingles having narrow end tabs 46*a*. Preferably, the pattern of tabs and cutouts results in all end tabs being greater than about 1.4 inches (3.6 centimeters) in the direction of the length L of the shingle. A pattern that assures the absence of narrow end tabs avoids the problem of having narrow end tabs break off, thereby eliminating a waste problem and a possible negative effect on the appearance of the shingles on the roof. Another advantage is that the shingle length is automatically controlled by the method of the invention.

It can be seen that the method of the invention is significantly more difficult to accomplish than the method disclosed in the Lamb patent. The apparatus must be able to simultaneously sense the distinct portions of multiple webs moving along separate paths, where the distinct portions are often barely perceptible from the surrounding areas of the webs, and where the webs are usually moving at a high rate of speed. The controller must be able to simultaneously recognize the locations of the distinct portions of all the webs, to compare the sensed locations with a program containing the desired locations of the end cuts relative to the distinct portions, and to control the movements of all the webs so that the distinct portions of the webs are aligned with each other as they approach the end cutter, and so that the end cutter cuts the webs at the predetermined desired locations relative to the distinct portions.

The principle and mode of operation of this invention have been described in its preferred embodiments. However, it should be noted that this invention may be practiced otherwise than as specifically illustrated and described without departing from its scope.

What is claimed is:

1. Apparatus for cutting multiple stacked webs of laminated, tabbed rooting shingle material comprising:

a multiple-cut shingle cutter adapted to simultaneously cut end cuts through multiple stacked webs of laminated, tabbed rooting shingle material to produce separate roofing shingles from the webs, each of the webs having distinct portions;

at least first and second feeders, each of the first and second feeders adapted to move at least a first and a second web alone separate paths to the cutter;

web handling apparatus adapted to receive the at least first and second webs from the first and second feeders, the web handling apparatus adapted to position the at least first and second webs of laminated, tabbed roofing shingle material in a stacked relationship prior to the cutter, wherein the at least second web is stacked below the at least first web;

location sensors adapted to sense the locations of the distinct portions of the moving at least first and second webs, wherein the distinct portions of the first and second webs form repeated patterns; and a controller adapted to control the location of the cutting, based on the sensed locations of the distinct portions of the multiple stacked webs, so that the end cuts of the separate rooting shingles are positioned at predetermined locations relative to the distinct portions.

2. The apparatus defined in claim 1 wherein the feeders are adapted to move the webs independently from each other, and wherein the controller is adapted to control the location of the cutting by controlling the movements of the webs.

3. The apparatus defined in claim 1 wherein the cutter is a rotating cutting cylinder, wherein the distinct portions of the webs form repeated patterns, and wherein the controller is adapted to control the movements of the webs so that the patterns are maintained in phase with the rotation of the cutting cylinder during the cutting.

4. The apparatus defined in claim 1 further including distance measuring devices to measure the lengths of the distinct portions.

5. The apparatus defined in claim 1 further including at least one means for inverting at least one of the webs so that the shingles produced from the webs are packaged face to-face/back-to-back in a bundle of shingles.

6. The apparatus defined in claim 1 wherein the controller is adapted for receiving at least one signal from each location sensor, comparing the signals received with a predetermined program, and determining at least one predetermined measured parameter of the distinct portion, determining the location of the distinct portion, and sending signals to the at least first and second feeders to vary the speed of at least one of the first or second feeders, whereby the end cuts are positioned at the predetermined locations relative to the distinct portion.

7. The apparatus defined in claim 1 wherein the controller comprises at least one microprocessor.

* * * * *

UNITED STATES PATENT AND TRADEMARK OFFICE

CERTIFICATE OF CORRECTION

PATENT NO. : 6,986,299 B2
APPLICATION NO. : 10/029514
DATED : January 17, 2006
INVENTOR(S) : White It is certified that error appears in the above-identified patent and that said Letters Patent is hereby corrected as shown below:

Column 7, Claim 1, Line 36, "rooting" should be --roofing--
Column 7, Claim 1, Line 39, "rooting" should be --roofing--
Column 7, Claim 1, Line 45, "alone" should be --along--
Column 8, Claim 1, Line 14, "rooting" should be --roofing--

Signed and Sealed this

Fifth Day of February, 2008

JON W. DUDAS
*Director of the United States Patent and Trademark Office*